US007866519B2

(12) United States Patent
Cortez, Jr.

(10) Patent No.: US 7,866,519 B2
(45) Date of Patent: Jan. 11, 2011

(54) CAM-ACTUATED PNEUMATIC SWITCH MECHANISM SYSTEM FOR CONTROLLING THE TIMED SPACING OF FASTENERS DRIVEN FROM HAND-HELD FASTENER-DRIVING TOOLS

(75) Inventor: Genaro Cortez, Jr., Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 29 days.

(21) Appl. No.: 12/385,561

(22) Filed: Apr. 13, 2009

(65) Prior Publication Data

US 2009/0294503 A1 Dec. 3, 2009

Related U.S. Application Data

(60) Provisional application No. 61/129,026, filed on May 30, 2008.

(51) Int. Cl.
*B21J 15/28* (2006.01)

(52) U.S. Cl. ..... 227/7; 227/3; 227/119; 227/130

(58) Field of Classification Search ..... 227/7, 227/3, 119, 130, 120, 129, 156
See application file for complete search history.

(56) References Cited

U.S. PATENT DOCUMENTS

| | | | | |
|---|---|---|---|---|
| 2,915,754 | A | 12/1959 | Wandel | |
| 3,193,164 | A | 7/1965 | Frasier | |
| 3,586,231 | A | 6/1971 | Wilson | |
| 3,628,714 | A | 12/1971 | Offenwanger | |
| 3,771,708 | A | 11/1973 | De Nicola et al. | |
| 3,796,365 | A | 3/1974 | Downing | |
| 3,957,191 | A | 5/1976 | Nelson, Jr. | |
| 3,984,040 | A | 10/1976 | Fry | |
| 3,992,768 | A | 11/1976 | De Nicola et al. | |
| 3,994,427 | A | 11/1976 | Ganatsiou | |
| 4,053,093 | A | 10/1977 | Thueringer | |
| 4,215,808 | A * | 8/1980 | Sollberger et al. | 227/146 |
| 4,225,074 | A | 9/1980 | Jacobson | |
| 4,463,887 | A | 8/1984 | Bloys | |
| 4,522,127 | A | 6/1985 | Miller et al. | |
| 4,523,706 | A | 6/1985 | Haley | |
| 4,605,149 | A | 8/1986 | Farrens et al. | |
| 4,732,307 | A | 3/1988 | Hubbard et al. | |
| 5,110,027 | A | 5/1992 | Burlingame | |
| 6,269,996 | B1 | 8/2001 | McAllister | |
| 6,527,156 | B2 | 3/2003 | McAllister et al. | |

FOREIGN PATENT DOCUMENTS

| | | |
|---|---|---|
| DE | 2007361 | 9/1971 |

* cited by examiner

*Primary Examiner*—Brian D Nash
(74) *Attorney, Agent, or Firm*—Law Offices of Steven W. Weinrieb

(57) ABSTRACT

A fastener-driving tool has a cam-actuated pneumatic switch mechanism system operatively incorporated thereon which is adapted to control the timed driving or discharge of fasteners out from a hand-held fastener-driving tool and into a substrate at predeterminedly spaced positions with respect to each other. The arrangement is particularly adapted for use in connection with the driving of fasteners into corner regions of structural workpieces, although the same may also be used to drive fasteners into flat planar surfaces.

11 Claims, 3 Drawing Sheets

CAM-ACTUATED PNEUMATIC SWITCH MECHANISM SYSTEM FOR CONTROLLING THE TIMED SPACING OF FASTENERS DRIVEN FROM HAND-HELD FASTENER-DRIVING TOOLS

CROSS-REFERENCE TO RELATED PATENT APPLICATIONS

This patent application is related to, and based upon, U.S. Provisional Patent Application Ser. No. 61/129,026 which was filed on May 30, 2008, the priority benefits of which are hereby claimed.

FIELD OF THE INVENTION

The present invention relates generally to fastener driving tools, and more particularly to a new and improved cam-actuated pneumatic switch mechanism system for controlling the timed driving or discharge of fasteners out from a hand-held fastener-driving tool such that the driven or discharged fasteners will be driven into a substrate at predeterminedly spaced positions with respect to each other, wherein the new and improved cam-actuated pneumatic switch mechanism system is particularly adapted for use in connection with the driving of fasteners into, for example, corner regions of various different structures or structural workpieces to be assembled together, as defined by means of angled or mitered joints of the structure or structural workpiece, and wherein the new and improved cam-actuated pneumatic switch mechanism system comprises a driver wheel which is adapted to be drivingly engaged with the corner region of the structure or structural workpiece, a driven wheel driven by the driver wheel, a cam mechanism disposed upon the driven wheel, a pneumatic switch mechanism disposed within the vicinity of the driven wheel so as to be capable of being actuated by means of the cam mechanism disposed upon the driven wheel, and another pneumatic switch mechanism fluidically connected to the pneumatic switch mechanism, operatively associated with the driven wheel, so as to control the firing of the fastener-driving tool.

BACKGROUND OF THE INVENTION

In connection with the fabrication of various different structures, substrates, or structural workpieces, fastener-driving tools are commonly used to drive fasteners into the structures, substrates, or workpieces at predetermined locations. More particularly, it is often desired to drive fasteners into the various different structures, substrates, or workpieces at locations that are separated from each other by means of predeterminedly uniformly spaced distances or intervals. Oftentimes, however, the firing of the fastener-driving tools is performed in a solely manual firing mode as opposed to, for example, an automatic firing mode, or in other words, the operator manually controls the firing of the fastener-driving tool. Accordingly, if it is in fact desired to drive fasteners into the structures, substrates, or workpieces at locations that are separated from each other by means of predeterminedly uniformly spaced distances or intervals, then unless the operator has previously performed particular measurements, and subsequently marked the locations accordingly at which the fasteners are to be inserted into the structures, substrates, or workpieces, the fasteners will not necessarily in fact be inserted into the structures, substrates, or workpieces at locations that are predeterminedly uniformly spaced from each other, but to the contrary, the locations at which the fasteners will in fact be driven or inserted into the structures, substrates, or workpieces will only be uniformly spaced from each other in a substantially approximated manner.

In order to rectify the deficiencies of such aforenoted manually-controlled fastener-driving tools, various different mechanisms have effectively been incorporated within, or operatively associated with, the fastener-driving tools so as to effectively cause the fastener-driving tools to be automatically fired at predeterminedly controlled times which are in fact separated from each other by means of uniformly spaced time intervals. Accordingly, in turn, fasteners will be driven out from the fastener-driving tool and into the particular structures, substrates, or workpieces at locations that are separated from each other by means of predeterminedly uniformly spaced distances or intervals. Exemplary embodiments of such fastener-driving tools are disclosed, for example, within U.S. Pat. No. 6,527,156 which was issued to McAllister et al. on Mar. 4, 2003, U.S. Pat. No. 5,110,027 which issued to Burlingame on May 5, 1992, U.S. Pat. No. 4,732,307 which was issued to Hubbard et al. on Mar. 22, 1988, U.S. Pat. No. 4,605,149 which issued to Farrens et al. on Aug. 12, 1986, U.S. Pat. No. 4,523,706 which was issued to Haley on Jun. 18, 1985, U.S. Pat. No. 4,053,093 which was issued to Thueringer on Oct. 11, 1977, U.S. Pat. No. 3,992,768 which issued to De Nicola et al. on Nov. 23, 1976, U.S. Pat. No. 3,984,040 which issued to Fry on Oct. 5, 1976, U.S. Pat. No. 3,586,231 which issued to Wilson on Jun. 22, 1971, and U.S. Pat. No. 2,915,754 which issued to Wandel on Dec. 8, 1959.

Continuing further, it is noted that, in conjunction with the aforenoted prior art patents and the systems disclosed therein, most of the various different fastener-driving tools are mounted upon carriage assemblies which provide a requisite amount of stability for their respective fastener-driving tools during, for example, a fastener-driving or fastener discharge operation which would naturally include or encompass a predetermined amount of recoil. Some of the other fastener-driving tools, such as, for example, Thueringer and Wandel, comprise hand-held fastener-driving tools wherein, for example, a single camming wheel is rotatably disposed at or upon the front or forward end portion of the fastener-driving tool so as to be operatively engaged upon a guide surface of the structure, substrate, or workpiece into which fasteners from the fastener-driving tool are to driven. In addition, it is also noted that the single camming wheel is rotatably upon the front or forward end portion of the fastener-driving tool so as to be located substantially adjacent to, or within the vicinity of, the location at which the fasteners will be discharged from the fastener-driving tool by means of the fastener-driving tool driver blade mechanism when the fastener-driving tool is fired. It has been observed, however, that, with fastener-driving tools of this type, when the fastener-driving tool is in fact fired so as to discharge a fastener into a structure, substrate, or workpiece, the single camming wheel may be momentarily disengaged from the guide surface of the structure, substrate, or workpiece.

Accordingly, due to the rotational or angular momentum or inertia of the rotatably mounted camming wheel, as a result of having been rotatably moved along the guide surface of the structure, substrate, or workpiece prior to the firing of the fastener-driving tool, when the camming wheel is momentarily disengaged from the guide surface of the substrate, structure, or workpiece, the camming wheel will effectively be free to continue to rotate until it is once again engaged with the guide surface of the structure, substrate, or workpiece in preparation for a subsequent cyclical firing of the fastener-driving tool in order to drive the fasteners into the structure, substrate, or workpiece at the predetermined locations uniformly spaced apart through means of equal distances or linear lengths. However, as a result of the aforenoted continued free rotation of the camming wheel as a result of the disengagement of the same from the guide surface of the substrate, structure, or workpiece, the cam member of the camming wheel will no longer effectively be in the same position as it was prior to the disengagement of the camming wheel from the guide surface of the structure, substrate, or workpiece. Therefore, it cannot be assured that the fastener-driving tool will in fact fire and discharge fasteners at predeterminedly equidistantly spaced intervals such that the discharged fasteners will be inserted into the structure, substrate, or workpiece at locations which are equally spaced apart from each other.

Continuing still further, it is also noted that the various systems disclosed within the aforenoted prior art patents are adapted for movement along flat planar surfaces into which the fasteners are to be driven. In connection with the fabrication of various different structures, substrates, or structural workpieces, wherein, for example, the various different structures, substrates, or structural workpieces may comprise an interior corner region into which fasteners are desired to be driven so as to fixedly connect a front side wall member of, for example, a furniture cabinet, to a left side wall member of the furniture cabinet, the aforenoted prior art systems disclosed within the aforenoted prior art patents are not able to be deployed or utilized because, obviously, the various different structures comprising such prior art systems disclosed within the aforenoted prior art patents will not in fact permit such fastener-driving tools to be physically accommodated within the corner regions of the substrates, structures, or workpieces into which the fasteners are to be driven. This is similarly the case in connection with the hand-held fastener-driving tools of Thueringer or Wandel. In Thueringer, for example, it is seen that the cam wheel is rotatably disposed within a plane which is offset from, or disposed parallel to, the plane within which the driver blade is disposed. This is similarly the case for some of the embodiments of Wandel, while in accordance with another embodiment of Wandel, the camming wheel is disposed within a plane which is oriented substantially perpendicular to the plane within which the driver blade is disposed. As can readily be appreciated, none of these structural embodiments would permit these fastener-driving tools to be utilized in connection with the fixation of fasteners within corner joints of various different structures, substrates, or workpieces.

A need therefore exists in the art for a new and improved fastener-driving tool which has means incorporated thereon which renders the same uniquely able to drive fasteners into corner regions of various different structures, substrates, workpieces, or the like, which are being assembled together, and at predetermined locations which are spaced apart by means of uniformly spaced intervals or distances, and wherein such means is not substantially adversely affected by means of tool recoil inherent to the firing or discharge of the fastener-driving tool.

SUMMARY OF THE INVENTION

The foregoing and other objectives are achieved in accordance with the teachings and principles of the present invention through the provision of a new and improved fastener-driving tool which comprises a new and improved cam-actuated pneumatic switch mechanism system for controlling the timed driving or discharge of the fasteners out from the fastener-driving tool such that the driven or discharged fasteners will be driven into a substrate at predeterminedly spaced positions with respect to each other. More particularly, the new and improved cam-actuated pneumatic switch mechanism system is particularly adapted for use in connection with the driving of fasteners into, for example, corner regions of various different structures or structural workpieces to be assembled together, as defined by means of angled or mitered joints of the structure or structural workpiece. In accordance with the principles and teachings of the present invention, the new and improved cam-actuated pneumatic switch mechanism system comprises a driver wheel which is adapted to be drivingly engaged with the corner region of the structure or structural workpiece, a driven wheel driven by the driver wheel through means of a suitable drive belt, chain, or the like, and a cam mechanism disposed upon the driven wheel.

A first pneumatic switch mechanism, activated by means of an operator-controlled lever or handle, is provided upon the fastener-driving tool so as to effectively control the inflow of a supply of compressed air from a source of compressed air, while a second pneumatic switch mechanism, fludically connected to the first pneumatic switch mechanism so as to be fluidically charged by means of the compressed air from the first pneumatic switch mechanism when the operator-controller lever or handle is actuated or depressed, is disposed within the vicinity of the driven wheel so as to be capable of being periodically actuated by means of the cam mechanism, disposed upon the driven wheel, each time the driven wheel completes a revolution. A third pneumatic switch mechanism is fluidically connected to the second pneumatic switch mechanism and is actuated by compressed air, transmitted from the second pneumatic switch mechanism to the third pneumatic switch mechanism when the second pneumatic switch mechanism is actuated by means of the cam mechanism disposed upon the driven wheel, so as to transmit the compressed air to the driver blade assembly of the fastener-driving tool in order to in fact fire the tool and permit the driver blade member to discharge a fastener into the corner region of the structure, substrate, or structural workpiece. It is lastly noted that the driver wheel, which is engaged within a corner region of the structure or structural workpiece into which the fasteners are to be driven, is disposed in a coplanar manner with respect to the driver blade member and is disposed ahead or in front of the driver blade member as considered in the direction of movement of the fastener-driving tool along the tool movement path which includes or encompasses the corner region of the structure or structural workpiece.

In this manner, not only does the driver wheel effectively guide the movement of the fastener-driving tool along a linear path which includes or encompasses the corner joint junction into which the fasteners are to be driven, but in addition, the disposition of the driver wheel in a coplanar manner with respect to the driver blade effectively ensures that the fasteners discharged from the fastener-driving tool will in fact be driven into the structure or structural workpiece along a path which is colinear with respect to that path traversed by the driver wheel and which effectively coincides with a path which includes or encompasses the corner joint junction such that the fasteners will in fact be inserted into the corner region of the structure or structural workpiece as desired. Still yet further, the use of the dual driver wheel and driven wheel system effectively ensures the fact that the driven wheel, upon which the cam mechanism is disposed, will undergo accurate rotational movement so as to, in turn, substantially accurately position the cam mechanism with respect to the second pneumatic switch mechanism. In this manner, the second pneumatic switch mechanism will be actuated at the desired predetermined times so as to, in turn, fire the fastener-driving tool at the desired predetermined times in order to discharge fasteners into the structure or structural workpiece with equidistantly spaced intervals defined between successive fasteners.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
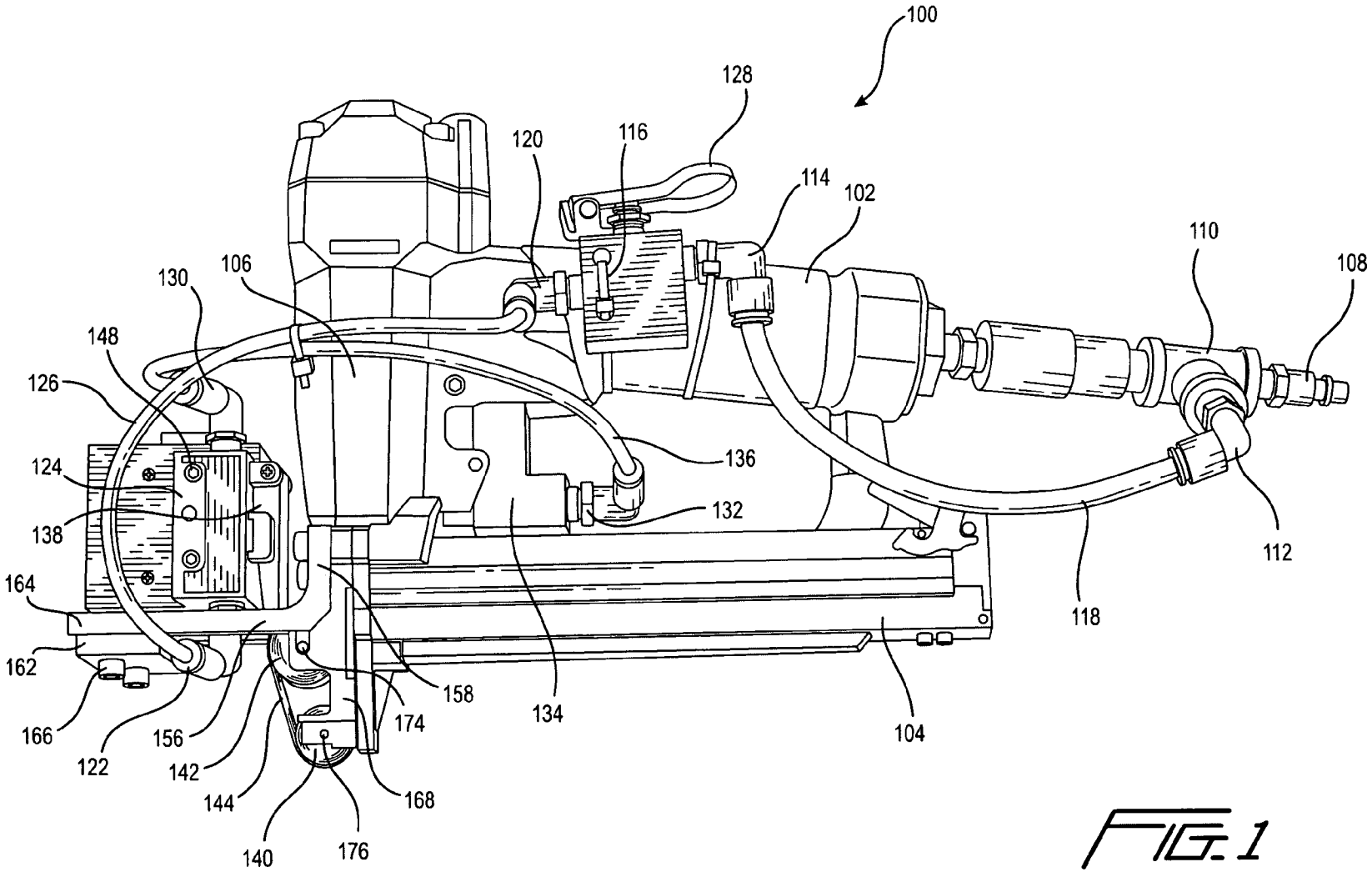
FIG. 1 is a side elevational view of a new and improved fastener-driving tool as constructed in accordance with the principles and teachings of the present invention and showing the cooperative parts thereof.

Referring now to the drawings, and more particularly to FIG. 1 thereof, a new and improved fastener-driving tool, which has been constructed in accordance with the principles and teachings of the present invention, and which comprises a new and improved cam-actuated pneumatic switch mechanism system for controlling the timed driving or discharge of the fasteners out from the fastener-driving tool such that the driven or discharged fasteners will be driven into a substrate or workpiece at predeterminedly spaced equidistant positions with respect to each other, is disclosed and is generally indicated by the reference character 100. More particularly, the new and improved fastener-driving tool 100 is particularly adapted for use in connection with the driving of fasteners into, for example, corner regions of various different structures or structural workpieces to be assembled together, as defined by means of angled or mitered joints of the structure or structural workpiece, and is seen to comprise, for example, a main body housing 102 which effectively serves as a handle by means of which the operator can hold and maneuver the tool, a fastener magazine 104 for housing a supply of fasteners to be driven into the structure or workpiece, and a driver blade housing 106 within which there is located a driver blade assembly for driving the lead fastener, moved outwardly from the fastener magazine 104 and into position along the driving path of the driver blade, out from the fastener-driving tool 100 and into the structure or workpiece. The fastener-driving tool 100 is adapted to be pneumatically powered and is therefore adapted to be fluidically connected to a source of compressed air, not shown, by means of a primary or main air fitting or connector 108. Ordinarily or normally, the compressed air from the primary or main air fitting or connector 108 would be routed through the main body housing 102 so as to drive the driver blade of the driver blade assembly disposed within the driver blade housing 106, however, for the purposes of the present invention, the fastener-driving tool 100 has effectively been modified so as to operatively incorporate therewithin the new and improved cam-actuated pneumatic switch mechanism system of the present invention.

More particularly, a diverter valve or similar type of connector 110 is disposed within the main air line leading to the main body housing 102 of the fastener-driving tool 100 so as to be interposed between the primary or main air fitting or connector 108 and the main body housing 102 of the fastener-driving tool 100. A first pneumatic or air fitting 112 is operatively connected to the diverter valve or connector 110, while a second pneumatic or air fitting 114 is operatively connected to an air intake or upstream end portion of a first pneumatic switch mechanism 116. A first pneumatic or air conduit 118 fluidically interconnects the first and second pneumatic or air fittings 114,116 together, and in this manner, compressed air, from the source of compressed air, not shown, is able to be fluidicially conducted to the first pneumatic switch mechanism 116 by means of the primary or main air fitting or connector 108, the first pneumatic or air fitting 112, the first pneumatic or air conduit 118, and the second pneumatic or air fitting 114. A third pneumatic or air fitting 120 is operatively connected to an air output or downstream end portion of the first pneumatic switch mechanism 116, while a fourth pneumatic or air fitting 122 is operatively connected to an air intake or upstream end portion of a second pneumatic switch mechanism 124. A second pneumatic or air conduit 126 fluidically interconnects the third and fourth pneumatic or air fittings 120,122 together, and the first pneumatic switch mechanism 116 is also provided with a pivotally mounted operator-controlled actuator lever 128. In this manner, when the operator-controlled actuator lever 128 is actuated or depressed, a supply of compressed air will be allowed to flow through the first pneumatic switch mechanism 116 and therefore be fluidicially conducted to the second pneumatic switch mechanism 124 by means of the third pneumatic or air fitting 120, the second pneumatic or air conduit 126, and the fourth pneumatic or air fitting 122.

Continuing further, it is also seen that a fifth pneumatic or air fitting 130 is operatively connected to an air output or downstream end portion of the second pneumatic switch mechanism 124, while a sixth pneumatic or air fitting 132 is operatively connected to an air intake or upstream end portion of a third pneumatic switch mechanism 134. A third pneumatic or air conduit 136 fluidically interconnects the fifth and sixth pneumatic or air fittings 130,132 together, and the second pneumatic switch mechanism 124 is also provided with a pivotally mounted cam-controlled actuator lever 138 as will be described hereinafter. In this manner, when the cam-controlled actuator lever 138 is actuated or depressed, as will be described hereinafter, a supply of compressed air will be allowed to flow through the second pneumatic switch mechanism 124 and therefore be fluidicially conducted to the third pneumatic switch mechanism 134 by means of the fifth pneumatic or air fitting 130, the third pneumatic or air conduit 136, and the sixth pneumatic or air fitting 132. The compressed air entering the third pneumatic switch mechanism 134 will then be conducted toward the driver blade assembly disposed within the driver blade housing 106 so as to in fact actuate the driver blade in order to effectively fire or discharge the fastener-driving tool 100 thereby driving a fastener into a structure or workpiece.

Figure 2:
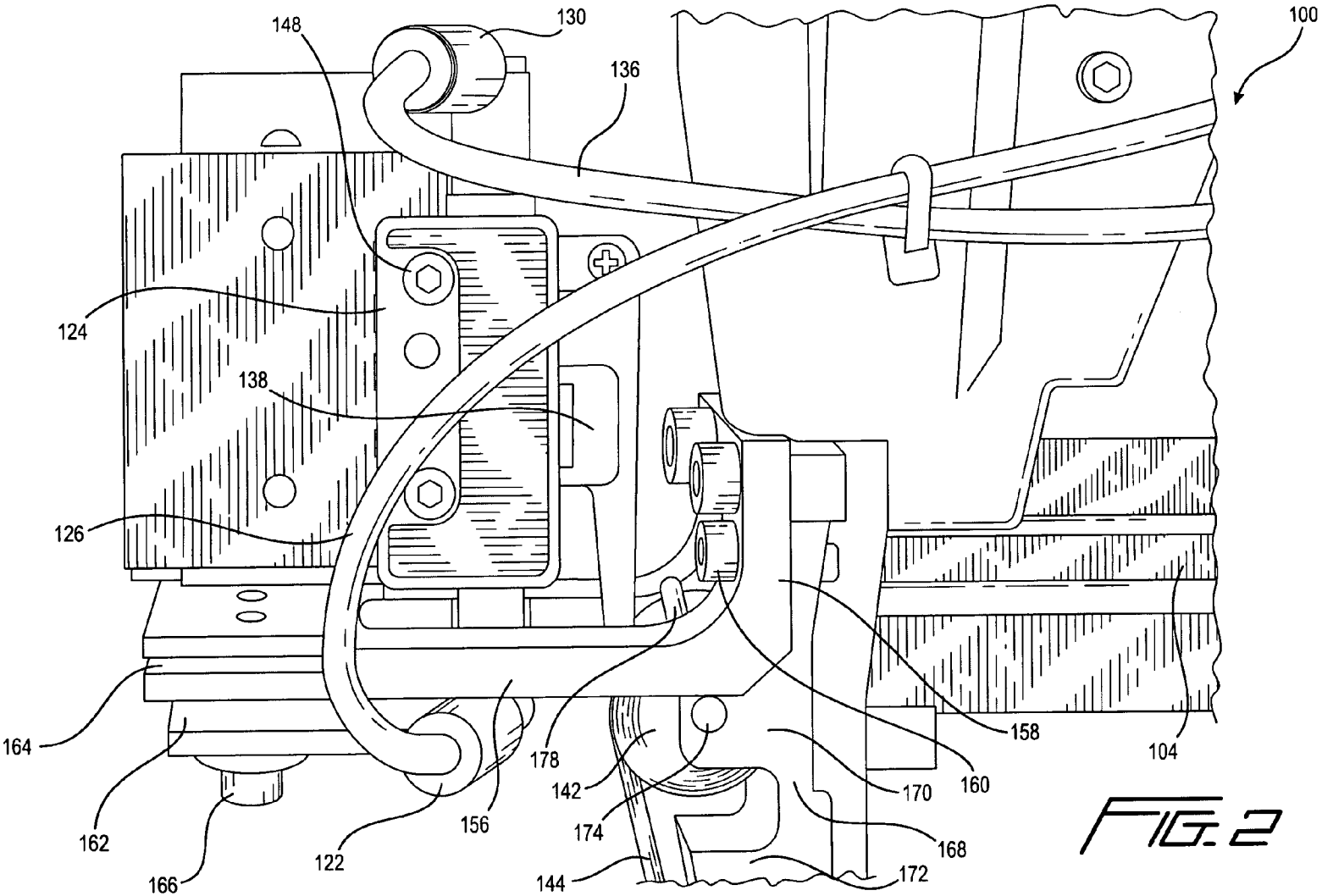
FIG. 2 is an enlarged side elevational view of the new and improved fastener-driving tool as disclosed within FIG. 1 clearly showing some detailed structure of the new and improved fastener-driving tool within the vicinity of the driven wheel, the cam pin mechanism disposed upon a peripheral edge portion thereof, and the actuating lever mechanism of the second pneumatic switch mechanism.

With reference now being additionally made to FIG. 2, it is also seen that the new and improved fastener-driving tool 100 further comprises a driver wheel 140 which is adapted to be effectively engaged with a surface portion of a structure or structural workpiece, and a driven wheel 142 which is adapted to be driven by means of the driver wheel 140 through means of a suitable drive belt, a drive chain, or the like 144. The driver wheel 140 has an annular groove, not shown, defined within an outer peripheral portion thereof, and in a similar manner, the driven wheel 142 likewise has an annular groove, also not shown, defined within an outer peripheral portion thereof. In this manner, the drive belt, drive chain, or the like 144 is able to be accommodated within the annular grooves respectively defined within the driver wheel 140 and the driven wheel 142 such that a drive train between the driver wheel 140 and the driven wheel 142 is effectively established.

It is also to be appreciated that in view of the fact that the drive belt, drive chain, or the like 144 is not only disposed within the annular groove de-fined within the outer peripheral portion of the driver wheel 140, but in addition, also extends radially outwardly beyond the radially outer extent of the driver wheel 140 as can be readily seen and understood from FIG. 1, then the drive belt, drive chain, or the like 144, and not the driver wheel 140, is actually disposed in engaged contact with the surface portion of the structure or workpiece into which the fasteners are to be driven. It is of course to be understood still further that in view of a relatively predetermined high degree of tension impressed upon the drive belt, drive chain, or the like 144, as a result of, for example, the adjustable mounting of one or both of the driver and driven wheels 140,142, no slippage occurs between the driver wheel 140 and the drive belt, drive chain, or the like 144. In this manner, an accurate degree or amount of rotation, experienced, undergone, or encountered by means of the drive belt, drive chain, or the like 144, as a result of its engagement with the surface portion of the structure or workpiece into which the fasteners are to be driven, is in fact effectively transmitted from the drive belt, the drive chain, or the like 144 to the driver wheel 140 and, in turn, to the driven wheel 142.

Figure 3:
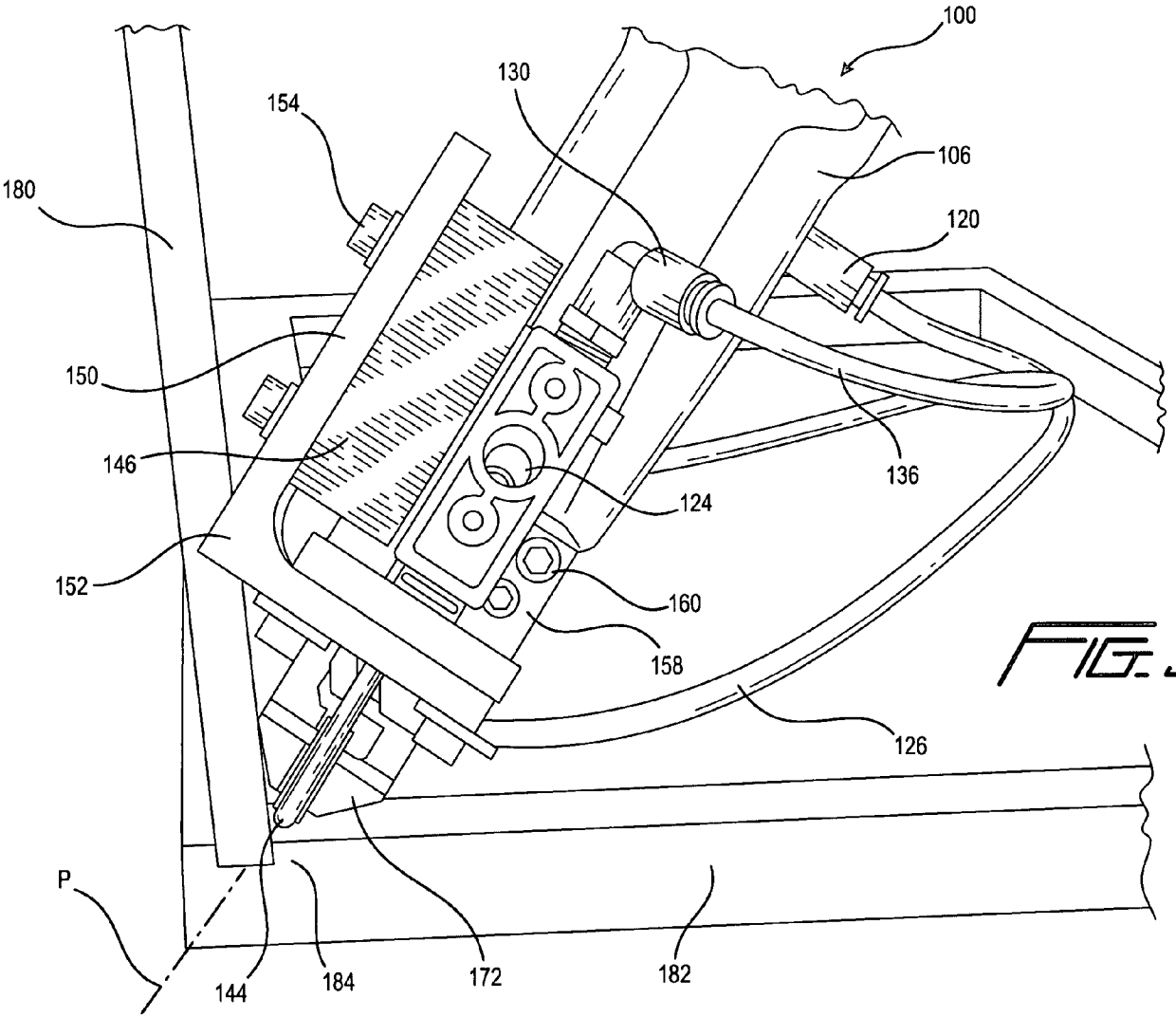
FIG. 3 is an enlarged end elevational view of the new and improved fastener-driving tool as disclosed within FIGS. 1 and 2, wherein the new and improved fastener-driving tool is being used to drive fasteners into a corner region of a structure or workpiece being assembled together.

Continuing still further, and with additional reference being made to FIG. 3, it is seen that the second pneumatic switch mechanism 124 is fixedly secured upon a mounting block 146 by means of, for example, suitable bolt fasteners 148, which can be seen in FIGS. 1 and 2, and that the mounting block 146 is, in turn, fixedly secured upon the upstanding leg member 150 of a first substantially L-shaped, mounting bracket 152 by means of, for example, a plurality of suitable bolt fasteners 154. A second substantially L-shaped mounting bracket 156 has its upstanding relatively short leg member 158 fixedly secured upon the fastener-driving tool 100, within the vicinity of the lower end portion of the driver blade assembly housing 106, by means of a plurality of bolt fasteners 160, as can best be seen from FIG. 3, while the substantially horizontally oriented leg member 162 of the first mounting bracket 152, upon which the second pneumatic switch mechanism 124 and the mounting block 146 are fixedly mounted, is fixedly secured to an undersurface portion of the distal end portion of the substantially horizontally oriented long leg member 164 of the second mounting bracket 156 by means of suitable bolt fasteners 166. Still yet further, a third mounting bracket 168 is also adapted to be fixedly secured or mounted upon the fastener-driving tool 100, within the vicinity of the lower end portion of the driver blade assembly housing 106, by means of a plurality of bolt fasteners, not shown, and it can be appreciated from FIGS. 1-3 that the third mounting bracket 168 is effectively provided with upper and lower clevis members 170,172 between which the driven and driver wheels 142,140 are respectively rotatably mounted as a result of the opposite end portions of the driven and driver wheel axles 174,176 being rotatably mounted within the upper and lower clevis members 170,172.

It is also to be appreciated that, in accordance with still additional principles and teachings of the present invention, the driven wheel 142 is provided with a radially outwardly projecting cam pin 178 upon an outer peripheral portion thereof so as to effectively be located adjacent to the peripheral groove within which the drive belt, drive chain, or the like 144 is disposed, as can best be appreciated from FIG. 2. It is also to be appreciated that the radially outwardly projecting cam pin 178 is also disposed within the vicinity of the lower end portion of the actuator lever 138 operatively connected to the second pneumatic switch mechanism 124. Accordingly, each time the driven wheel 142 completes a revolution, the cam pin 178 will engage the actuator lever 138 such that the same effectively opens the second pneumatic switch mechanism 124 and permits a charge of compressed air to effectively be conducted from the second pneumatic or air conduit 126 and into the third pneumatic or air conduit 136 so as to be fluidically conducted or delivered into the third pneumatic switch mechanism 134 whereby the compressed air can actuate or move the driver blade of the driver blade assembly disposed within the driver blade housing 106 and thereby fire and discharge a fastener into a structure or workpiece. Accordingly, due to the effective rolling engagement of the driver wheel 140, through means of the drive belt, drive chain, or the like 144, along a surface portion of a structure or workpiece into which fasteners are to be driven by means of the fastener-driving tool 100, and the effective transmission of such rolling engagement of the driver wheel 140 to the driven wheel 142, the cam pin 178 of the driven wheel 142 will actuate the second pneumatic switch mechanism 124, through means of the cam-controlled actuator lever 138, at predeterminedly controlled times such that fasteners will be continuously driven into the structure or substrate, by means of the fastener-driving tool 100 with equidistant spaces or intervals defined between successive fasteners, as long as the operator-controlled actuator lever 128 is maintained at its depressed or actuated state or position.

It is additionally noted that, in accordance with further unique and novel structural features characteristic of the present invention, the driver wheel 140, which is effectively engaged with a surface portion of the structure or workpiece into which the fasteners from the fastener-driving tool are to be driven, and which therefore effectively determines the spacing intervals defined between successively fired or discharged fasteners as has been described hereinbefore, is not disposed within a plane which is disposed perpendicular or parallel to the plane within which the driver blade of the fastener-driving tool is disposed, as disclosed, for example, within the previously noted patents to Wandel or Thueringer. To the contrary, the driver wheel 140, as well as the driven wheel 142, is disposed in a coplanar manner with respect to the driver blade of the fastener-driving tool 100, such coplanar arrangement being effectively illustrated in a schematic manner, within FIG. 3, by means of the common plane designated P. More particularly, it can be further appreciated that the driver blade of the fastener-driving tool 100 will, in effect, be disposed in the aforenoted coplanar manner and substantially directly behind the driver wheel 140 and the driven wheel 142 as considered in the direction of movement of the fastener-driving tool 100. It is additionally seen from FIG. 3 that the lower end portions of the oppositely disposed members defining the lower clevis member 172, for mounting the driver wheel 140, have substantially triangular configurations. Accordingly, all of these structural features characteristic of the new and improved cam-actuated pneumatic-switch system of the fastener-driving tool 100 uniquely permit or facilitate the use of the fastener-driving tool 100 for installing fasteners within internal corner regions of different structures or structural workpieces, as can also be readily appreciated from FIG. 3.

More particularly, when a structural workpiece, such as, for example, a furniture cabinet, is to be assembled together, the cabinet will often, of course, have corner regions defined therein. As illustrated within FIG. 3, the cabinet may comprise, for example, an upstanding or vertically oriented side wall member 180 and a horizontally oriented base member 182 wherein the two members 180,182 are to be affixed together at an internal corner region 184 of the cabinet. Therefore, in order to readily fasten the upstanding or vertically oriented side wall member 180 to the horizontally oriented base member 182, the fastener-driving tool 100 can be oriented as illustrated within FIG. 3 whereby the driver wheel 140, and the peripherally mounted drive belt, drive chain, or the like 144, will be oriented within the internal corner region of the cabinet. It is noted that the triangularly configured portions of the lower clevis member 172 effectively assist in guiding the driver wheel 140 and the fastener-driving tool 100 along the internal corner region of the cabinet as a result of the triangularly configured portions of the lower clevis member 172 effectively engaging interior surface portions of one or both of the upstanding or vertically oriented side wall member 180 and the horizontally oriented base member 182 of the cabinet.

Accordingly, as a result of the aforenoted relative coplanar disposition of the driver wheel 140 with respect to the driver blade of the fastener-driving tool 100, not only does the driver wheel 140 effectively guide the movement of the fastener-driving tool 100, and the driver blade thereof, along a linear path which includes or encompasses the internal corner joint junction 184 into which the fasteners are to be driven, as a result of the driver wheel 140 being disposed in front or ahead of the driver blade of the fastener-driving tool 100 as considered in the direction of movement of the fastener-driving tool 100 along the tool movement path which includes or encompasses the internal corner region of the workpiece or cabinet structure, but in addition, the disposition of the driver wheel 140 in the coplanar manner with respect to the driver blade effectively ensures the fact that the fasteners to be discharged from the fastener-driving tool 100 will in fact be driven into the structural workpiece or cabinet along a path which is colinear with the path traversed by the driver wheel 140 and which effectively coincides with a path that includes or encompasses the internal corner joint junction 184 of the cabinet such that the fasteners will in fact be inserted into the internal corner region 184 of the cabinet structure or structural workpiece as desired.

It is lastly noted that the use of the dual driver wheel 140 and driven wheel 142 system is unique and novel in that the same effectively ensures the fact that the driven wheel 142, upon which the cam pin 178 is disposed, will always undergo substantially accurate rotational movement and will always be substantially accurately angularly positioned with respect to the cam-controlled actuator lever 138 of the second pneumatic switch mechanism 124 so as to, in turn, substantially accurately position the cam pin 178 with respect to the cam-controlled actuator lever 138 of the second pneumatic switch mechanism 124 even if the driver wheel 140 and the drive belt, drive chain, or the like 144 may be momentarily disengaged from the structure or substrate along which the fastener-driving tool 100 is being moved and into which the fasteners are being driven, such as, for example, during recoil of the fastener-driving tool 100 attendant a firing or fastener discharge of the fastener-driving tool 100. More particularly, as has been previously noted, it has been observed that, with fastener-driving tools of the types disclosed within either one of, for example, the patents to Wandel or Thueringer, when the fastener-driving tool is in fact fired so as to discharge a fastener into a structure, substrate, or workpiece, the single camming wheel of such patented systems may be momentarily disengaged from the guide surface of the structure, substrate, or workpiece along which the fastener-driving tool is being moved.

Accordingly, due to the rotational or angular momentum or inertia of the rotatably mounted camming wheel, as a result of having been rotatably moved along a particular guide surface of the substrate, structure, or workpiece prior to the firing of the fastener-driving tool, when the camming wheel is momentarily disengaged from the guide surface of the structure, substrate or workpiece, the camming wheel will effectively be free to continue to rotate until it is once again engaged with the guide surface of the structure, substrate, or workpiece in preparation for a subsequent cyclical firing of the fastener-driving tool in order to drive the fasteners into the structure, substrate, or workpiece at the predetermined locations uniformly spaced apart through means of equal distances or linear lengths. However, as a result of the aforenoted continued free rotation of the camming wheel as a result of the disengagement of the same from the guide surface of the substrate, structure, or workpiece, the cam member of the camming wheel will no longer effectively be in the same angular position as it was prior to the disengagement of the camming wheel from the guide surface of the substrate, structure, or workpiece. Therefore, it cannot be assured that the fastener-driving tool will in fact fire and discharge fasteners at predeterminedly equidistantly spaced intervals such that the discharged fasteners will in fact be inserted into the structure, substrate, or workpiece at locations which are equally spaced apart from each other.

In accordance with the dual driver wheel 140 and driven wheel 142 system of the present invention, however, it has been observed that the connection of the driver wheel 140 to the driven wheel 142, by means of the drive belt, drive chain, or the like 142, tends to inherently generate a sufficient amount of friction with the dual wheel drive system such that any substantial or significant amount of free-wheel rotation of the drive wheel 140 will effectively be prevented. In other words, the connection of the driver wheel 140 to the driven wheel 142, by means of the drive belt, drive chain or the like 142, tends to have a retarding effect upon any freewheeling rotation of the driver wheel 140 such that substantially no further inadvertent driving of the driven wheel 142 is achieved. Accordingly, the cam pin 178 disposed upon the outer periphery of the driven wheel 142 will always be substantially properly angularly oriented with respect to the cam-controlled actuator lever 138 of the second pneumatic switch mechanism 124 so as to in fact properly actuate the same at the predeterminedly desired times. In this manner, the fastener-driving tool 100 will be fired at the desired predetermined times in order to discharge fasteners into the structure or structural workpiece with equidistantly spaced intervals defined between successive fasteners.

Thus, it may be seen that in accordance with the principles and teachings of the present invention, there has been provided a new and improved cam-actuated pneumatic switch mechanism system for controlling the timed driving or discharge of fasteners out from a hand-held fastener-driving tool such that the driven or discharged fasteners will be driven into a substrate at predeterminedly spaced positions with respect to each other. The new and improved cam-actuated pneumatic switch mechanism system is particularly adapted for use in connection with the driving of fasteners into, for example, corner regions of various different structures or structural workpieces to be assembled together, as a result of a driver wheel being located in an in-line or coplanar manner with respect to the driver blade of the fastener-driving tool. The driver wheel, in turn, drives a driven wheel upon which there is located a camming pin for controlling the actuation of an actuation lever of a pneumatic switch mechanism of the overall cam-actuated pneumatic switch mechanism system so as to cause firing of the fastener-driving tool. In addition, the utilization of the dual wheel drive system effectively prevents or retards freewheel rotation of the driver wheel so as to, in turn, prevent improper disposition or location of the camming pin with respect to the pneumatic switch mechanism.

Obviously, many variations and modifications of the present invention are possible in light of the above teachings. In addition, it is noted that the system of the present invention can be utilized other than as specifically described, such as, for example, in lieu of being utilized for driving fasteners into corner regions of a structure or workpiece, the present invention system can also be utilized in connection with the driving of fasteners into flat planar surfaces wherein, for example, the driver wheel and the drive belt, drive chain, or the like, would rollingly engage the flat planar surface. It is therefore to be understood that within the scope of the appended claims, the present invention may be practiced otherwise than as specifically described herein.

What is claimed as new and desired to be protected by Letters Patent of the United States of America, is:

1. A hand-held fastener-driving tool for driving fasteners into a workpiece structure, comprising:

a main body housing serving as a handle by means of which said hand-held fastener-driving tool may be held and manipulated by an operator;

a pneumatic supply source fluidically connected to said hand-held fastener-driving tool for supplying pneumatic fluid to said hand-held fastener-driving tool;

a driver blade housing fixedly connected to said main body housing and containing a driver blade for driving fasteners outwardly from said hand-held fastener-driving tool;

pneumatic switch structure mounted upon said hand-held fastener-driving tool and operatively connected to said driver blade housing for actuating said driver blade disposed within said driver blade housing by means of pneumatic fluid supplied to said hand-held fastener-driving tool from said pneumatic supply source;

a first drive wheel rotatably mounted upon said hand-held fastener-driving tool so as to be rotated as a result of operative engagement with the workpiece structure as said hand-held fastener-driving tool is moved along the work-piece structure;

a second driven wheel rotatably mounted upon said hand-held fastener-driving tool;

a drive connection drivingly interconnecting said first drive wheel with said second driven wheel such that said second driven wheel is rotatably driven in a manner similar to the rotation of said first drive wheel;

a cam actuated mechanism mounted upon said hand-held fastener driving tool so as to periodically actuate said pneumatic switch structure in order to provide pneumatic fluid to said driver blade housing and said driver blade disposed within said driver blade housing so as to control the driving of fasteners out from said fastener-driving tool at predetermined times by said driver blade as said hand-held fastener-driving tool is moved along the workpiece structure; and a cam pin actuator mounted upon said second driven wheel for operatively engaging said cam actuated mechanism, at predetermined times, when said second driven wheel undergoes consecutive complete revolutions, such that pneumatic fluid is conducted from said pneumatic switch structure and toward said driver blade disposed within said driver blade housing whereby fasteners are driven outwardly from said hand-held fastener-driving tool at predetermined time intervals whereby fasteners are driven into the workpiece structure at locations which are uniformly spaced apart from each other.

2. The fastener-driving tool as set forth in claim 1, wherein said pneumatic switch structure comprises:

a first pneumatic switch mechanism to be actuated by said cam actuated mechanism; and a second pneumatic switch mechanism to be actuated by pneumatic fluid from said first pneumatic switch mechanism and to, in turn, actuate said driver blade disposed within said driver blade housing, by pneumatic fluid, so as to drive fasteners outwardly from said hand-held fastener-driving tool.

3. The fastener-driving tool as set forth in claim 2, further comprising:

a third pneumatic switch mechanism fluidically connected to said first pneumatic switch mechanism; and an operator-controlled lever operatively associated with said third pneumatic switch mechanism so as to permit pneumatic fluid to enter said third pneumatic switch mechanism and be fludically conducted from said pneumatic supply source toward said first pneumatic switch mechanism when said operator-controlled level is actuated.

4. The fastener-driving tool as set forth in claim 1, wherein:

said drive connection drivingly interconnecting said first drive wheel with said second driven wheel comprises an endless loop device.

5. The fastener-driving tool as set forth in claim 4, wherein:

said first drive wheel and said second driven wheel have grooves defined within outer peripheral portions thereof; and said endless loop drive connection for drivingly interconnecting said first drive wheel with said second driven wheel, such that said second driven wheel is rotatably driven in a manner similar to the rotation of said first drive wheel, comprises a drive belt disposed within said grooves defined within said outer peripheral portions of said first drive wheel and said second driven wheel.

6. The fastener-driving tool as set forth in claim 5, wherein:

said drive belt projects radially outwardly from said groove defined within said first drive wheel such that drive belt operatively engages a surface portion of the work-piece structure as said hand-held fastener-driving tool is moved along the surface portion of the workpiece structure.

7. The fastener-driving tool as set forth in claim 5, wherein:

said first drive wheel, said second driven wheel, and said drive belt comprise a drive system which effectively prevents said second driven wheel from freely rotating and thereby altering the true angular disposition and location of said cam pin actuator with respect to said pneumatic switch structure, when said first drive wheel is momentarily disengaged from the workpiece structure, so as to ensure that the fasteners are driven outwardly from said hand-held fastener-driving tool at said predetermined time intervals such that the fasteners are driven into the work-piece structure at locations which are uniformly spaced apart from each other.

8. The fastener-driving tool as set forth in claim 5, wherein:

said first drive wheel and said second driven wheel are mounted upon said hand-held fastener-driving tool by clevis structures.

9. The fastener-driving tool as set forth in claim 8, wherein:

said clevis structures comprise triangularly configured portions for permitting said first drive wheel to be disposed within corner regions of the workpiece structure so as to permit said hand-held fastener-driving tool to be moved along the corner region of the workpiece structure in order to install fasteners into the corner regions of the workpiece structure.

10. The fastener-driving tool as set forth in claim 5, wherein:

said first drive wheel, said second driven wheel, and said drive belt are disposed in a coplanar manner with respect to said driver blade housing, and are disposed forwardly of said driver blade housing, as considered in the direction of movement of said hand-held fastener-driving tool along the workpiece structure, such that said first drive wheel, said second driven wheel, and said drive belt are disposed in a coplanar manner with respect to the driver blade disposed within said driver blade housing whereby fasteners will be driven outwardly from said hand-held fastener-driving tool along a path actually traversed by said first drive wheel.

11. The fastener-driving tool as set forth in claim 1, further comprising:

a magazine fixedly mounted upon said main body housing means and operatively connected to said driver blade housing for serially supplying fasteners to said driver blade housing such that the fasteners can be driven out from said hand-held fastener-driving tool by said driver blade disposed within said driver blade housing.

* * * * *